United States Patent [19]

Lewis

[11] 3,998,021

[45] Dec. 21, 1976

[54] INSULATED SIDING PANEL ASSEMBLY

[76] Inventor: Eugene R. Lewis, 9 Candee Road, Prospect, Conn. 06712

[22] Filed: Sept. 8, 1975

[21] Appl. No.: 611,192

[52] U.S. Cl. ..... 52/531; 52/404

[51] Int. Cl.[2] ..... E04B 1/62; E04D 1/28

[58] Field of Search ..... 52/529–540, 52/404

[56] References Cited

UNITED STATES PATENTS

| | | | |
|---|---|---|---|
| 1,094,893 | 4/1914 | Grant | 52/531 |
| 2,409,951 | 10/1946 | Nootens | 52/404 |
| 3,110,130 | 11/1963 | Trachtenberg | 52/404 X |
| 3,158,960 | 12/1964 | Newton et al. | 52/529 X |
| 3,159,943 | 12/1964 | Sugar et al. | 52/531 |
| 3,371,457 | 3/1968 | Wienand | 52/404 |
| 3,420,027 | 1/1969 | Creveling | 52/529 |

FOREIGN PATENTS OR APPLICATIONS

| | | | |
|---|---|---|---|
| 2,015,134 | 4/1970 | France | 52/529 |

*Primary Examiner*—J. Karl Bell

[57] ABSTRACT

An insulated siding panel assembly comprises an elongated outer panel of sheet material supported to resist deformation thereof by an elongated synthetic resin backing member disposed therebehind. The backing member has at least one reinforcing rib projecting away from the outer panel and configured to abut a vertical support surface when the panel assembly is mounted thereon, preferably in an overlapping clapboard configuration. The outer panel and backing member may each comprise two offset parallel body portions so that each panel assembly presents a double clapboard configuration, and each body portion of the backing member then has a rib to provide support. The siding panels may be mounted upon transversely extending stringers which in turn are mounted upon a support surface. The backing members are desirably closed cell foamed structures.

11 Claims, 6 Drawing Figures

INSULATED SIDING PANEL ASSEMBLY

BACKGROUND OF THE INVENTION

It is well known to provide siding fabricated of sheet material such as aluminum backed with a synthetic resin panel for insulation. However, when aluminum siding has a clapboard configuration formed by interconnecting overlapping panels the typically used polystyrene insulating backer does not provide sufficient rigidity and support for the siding panel. As a result, the siding panels may be easily deformed and gaps may occur in the overlapping joints which permit entry of the elements as well as insects. Furthermore, any bows or hollows in the aluminum panels result in an alteration of the light reflectivity thereof and give the impression of color variations.

Accordingly, it is an object of the present invention to provide a novel insulated siding panel assembly having a synthetic resin backing member which is inexpensive and easy to manufacture and which provides improved support for the outer panel.

It is also an object to provide such an insulated siding panel assembly which may be easily interengaged to an adjacent panel and secured to a vertical support surface in a clapboard configuration.

Another object is to provide such an assembly which utilizes offset body sections to provide a double clapboard configuration.

SUMMARY OF THE INVENTION

It has now been found that the foregoing and related objects of the present invention are readily attained in an insulated siding panel assembly comprising an elongated outer panel formed of deformable sheet material and having a body section providing inside and outside faces and a flange extending along at least one longitudinal edge thereof. The siding panel assembly includes an elongated synthetic resin backing member of greater thickness than the sheet material of the outer panel disposed against the inner face thereof. The backing member has at least one rib thereon spaced intermediate the longitudinal edge thereof and projecting away from the inner face of the outer panel, the backing member providing resistance to deformation of the outer panel.

In another embodiment of the siding panel assembly the outer panel and the backing member each have a transverse configuration providing two body sections extending in generally parallel planes joined by a web extending at an angle to the planes of the body sections in the same direction as the flange to space the planes of the body sections. Each of the backing member body sections has a longitudinally extending rib, and the siding panel assembly has a double clapboard configuration with each section of the siding panel supported for resistance to deformation.

In the preferred embodiment the flange extends inwardly of the inner face of the outer panel and has a lip extending in spaced relationship to the inner face to provide a U-shaped channel along one longitudinal edge of the outer panel. The outer panel has a second flange extending adjacent the other longitudinal edge thereof and outwardly of the outer face thereof.

The synthetic resin backing member preferably has a closed cellular structure and is of substantially uniform thickness. The rib is defined by a corrugation providing a recess in the opposite surface of the backing member.

A plurality of siding panel assemblies of either embodiment may be interengaged to provide an insulated siding assembly having a clapboard configuration. Each outer panel has flanges extending along both longitudinal edges thereof, flanges of adjacent panels being interengaged to provide the siding assembly.

Preferably one flange on each outer panel extends inwardly of the inner face of the outer panel and has a lip as defined above to provide a U-shaped channel, the other flange extending outwardly of the outer face thereof. The U-shaped channel on one of the outer panels seats the other flange of the adjacent outer panel to secure the siding panel assemblies in a clapboard configuration.

Siding panel assemblies may be mounted to a plurality of spaced stringers extending transversely thereto. Each stringer has mounting means longitudinally spaced thereon which cooperate with the U-shaped channels and other flanges of outer panels to secure siding panel assemblies to the stringers.

The distance from the plane of the backing member face adjacent the outer panel to the opposite face of the rib at its maximum spacing exceeds the width of the flanges. The ribs abut a vertical support surface when the siding panel assemblies are mounted thereon to provide resistance to deformation of the outer panels.

DETAILED DESCRIPTION OF THE ILLUSTRATED EMBODIMENTS

Figure 1:
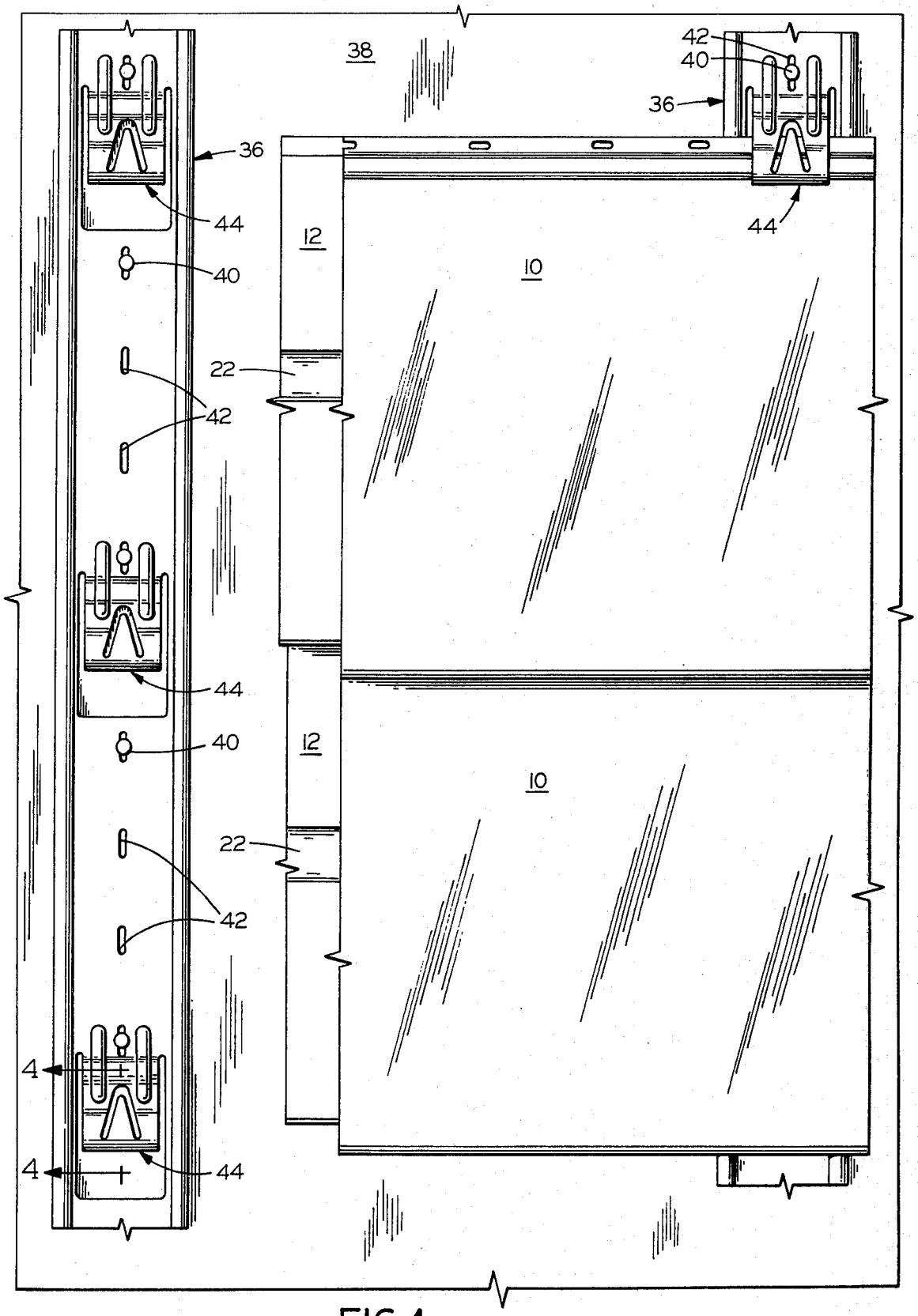
FIG. 1 is a fragmentary front elevational view of a siding installation with two interconnected siding panel assemblies of the present invention mounted upon a pair of stringers with the panels broken away to show underlying construction.
Figure 2:
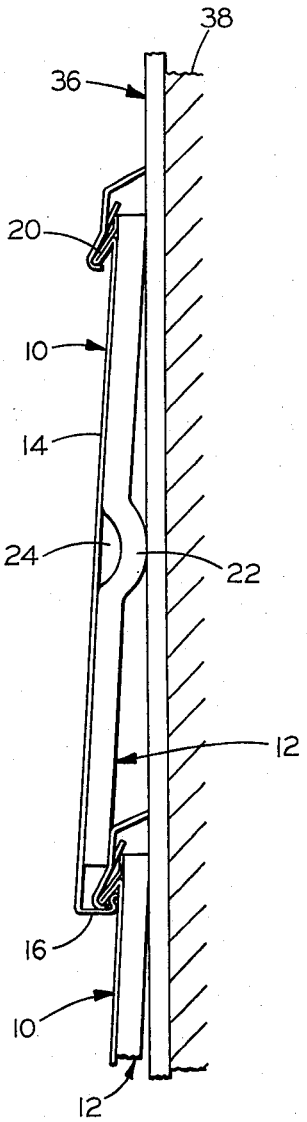
FIG. 2 is a fragmentary side elevational view of the installation assembly of FIG. 1.

Turning now in detail to the drawings and in particular to FIGS. 1 and 2 thereof, illustrated therein is a siding panel installation embodying the siding panel assembly of the present invention which comprises an elongated outer panel formed of deformable sheet material and generally designated by the numeral 10, and an elongated synthetic resin backing member generally designated by the numeral 12. The siding panel assemblies are mounted upon vertical stringers generally designated by the numeral 36 which are secured to the wall of the building 38.

Figure 5:
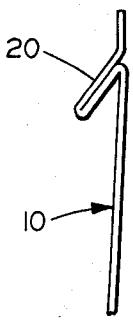
FIG. 5 is a fragmentary side elevational view of an outer panel showing the upper flange thereof drawn to the same scale as FIG. 4.
Figure 6:
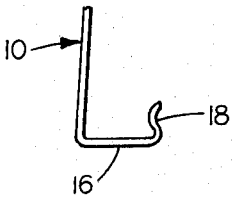
FIG. 6 is a fragmentary side elevational view of an outer panel showing the lower flange thereof drawn to the same scale as FIG. 4.

As best seen in FIGS. 2, 5 and 6, the outer panel 10 has a planar body portion 14 and along its lower longitudinal edge it has projecting perpendicularly inwardly therefrom a flange 16 with an upstanding lip 18 thereon to provide a generally U-shaped channel. Adjacent its upper longitudinal edge, the outer panel 10 has a reversely bent flange 20 projecting outwardly therefrom at an acute angle to provide a downwardly opening V-shaped channel in cooperation with the body portion 14.

Abutting the inner surface of the outer panel 10 is the backing member 12 which is of greater thickness than the sheet material from which the outer panel 10 is fabricated. The backing member 12 has a longitudinal rib of arcuate cross section on its inner surface projecting away from the outer panel 10 and a recess 24 of complimentary configuration in its outer surface. The rib 22 abuts the stringers 36 and functions to provide resistance to deformation of the outer panel 10 in a manner to be described hereinafter.

Figure 4:
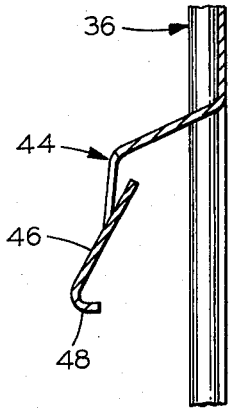
FIG. 4 is a cross sectional view along the line 4—4 of FIG. 1 and drawn to an enlarged scale.

As shown in FIGS. 1 and 2, siding panel assemblies are mounted upon vertical stringers 36 horizontally spaced a suitable distance (generally 12–30 inches) relative to a wall 38 to which they are secured. Referring also to FIG. 4, each stringer 36 has vertically spaced outwardly extending and resiliently deformable clips generally designated by the numeral 44, each having downwardly and outwardly extending engagement portion 46 and an inwardly turned arcuate lip portion 48. The stringers 36 also have vertically spaced slots 42 therein for fasteners 40 to effect mounting upon the wall 38.

Siding panel assemblies comprising the backing member 12 behind the outer panel 10 are mounted upon the stringers 36 which have previously been secured to the wall 38 by fasteners 40 beginning with the lowermost panel assembly. The flange 20 adjacent the upper edge of the outer panel 10 is snapped into place in the clip 44 intermediate the engagement portions 46 and the body of the stringers 36 with the backing member 12 in position. The edge portion of the flange 20 seat in the arcuate lip portions 48. Following this engagement, the lower edge of the siding panel assembly is secured to the stringers 36 by deforming the flange 16, lip 18 and clip 44 sufficiently to permit the lip 18 to be positioned between the arcuate lip portion 48 and body of the stringers 36. In assembling the next higher panel assembly, the steps are essentially the same except that the flange 16 fits about both the lip 48 of the stringer clip 44 and the flange 20 which is seated therein. These steps are repeated until the wall 38 is covered. Support is provided to the outer panel 10 by the rib 22 abutting the stringers 36, the lower edge portion of the backing member 12 abutting the clips 44, and the upper edge portion of backing member 12 abutting the body of the stringers 36.

Figure 3:
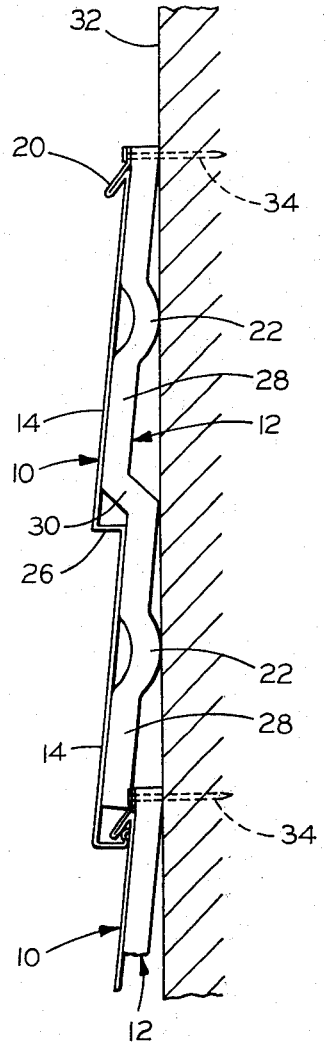
FIG. 3 is a fragmentary side elevational view of an installation utilizing another siding panel assembly embodiment.

An alternate manner of mounting siding panel assemblies to the vertical support surfaces is shown in FIG. 3. The siding panel assemblies are mounted directly upon a wall 32. The upper edge of the lowermost panel to be mounted is first secured to the wall 32 by suitable fasteners 34 such as nails extending through the spaced apertures therein. Shim means (not shown) may be provided along the lower edge thereof to space it from the wall 32 to match the angle of upper panels. Referring also to FIGS. 5 and 6, the lip 18 of the next panel assembly to be mounted is then hooked under the flange 20 of the previously mounted panel assembly. The upper edge of the panel assembly being mounted is secured to the wall 32 by fasteners 34. These steps are repeated until the wall 32 is covered. In this embodiment of installation the ribs 22 abut the wall 32 over the full length of the panel assemblies so as to provide support for the outer panels 10.

Shown in FIG. 3 is an alternate embodiment of the siding panel assembly wherein the outer panel 10 and backing member 12 are configured to provide a double clapboard assembly. The outer panel 10 has two offset parallel body portions 14 connected by the web 26, and the backing member 12 has two offset parallel body sections 28 connected by the web 30. The remaining structure is as described with reference to the embodiment of FIGS. 1 and 2.

It should be obvious that either embodiment of the siding panel assembly may be mounted directly to a wall or to a plurality of spaced stringers.

As will be appreciated by viewing FIGS. 2 and 3, the depth and vertical dispostion of the ribs 22 relative to the backing members 12, as well as the disposition of the base of the web 30, may be varied so long as the ribs 22 and base of the web 30 abut the stringer 36 or wall 38 to provide the desired reinforcement when panels are mounted in a clapboard configuration. Furthermore, a plurality of ribs of varying depths depending on vertical position on the backing member may be used for added support, or the rib may be discontinuous along the length. Moreover, the rib may have a configuration of other than arcuate cross section, and the rib may be provided by protuberances from a body of uniform thickness rather than one having a groove in the surface opposite that having the rib.

If only one rib is used per backing member body section it should be positioned near the center thereof for maximum support. The backing members are reversible so that neither edge may be predetermined as the top or bottom edge thereof for installation purposes. They are also configured for snugly stacking to facilitate storage and shipping.

Referring again to FIGS. 2 and 3, the manner of using overlapping flanges when interconnecting adjacent siding panels provides a configuration which provides a barrier to the elements and insects. The fact that wind flow behind the outer panels is effectively precluded adds the insulating property of the air trapped therebehind to that of the backing member.

The outer panels may be of any conventional material including aluminum, steel and polyvinyl chloride. The insulating backing member is formed of any suitable synthetic resin of good insulating properties. To provide lightweight, highly effective insulation closed cell foam structures are desirable. Relative rigidity of the resin structure is also a factor to be considered in order to provide the desired support for the outer panel. Among the resins which may be employed are polystyrene, polyethylene, polyurethane and polyvinyl chloride.

The relative thicknesses of the outer panel and backing member are on the order of 1–3:15, typical thickness being 1/32 inch for the outer panel and three-eight inch for the backing member. Of course, these dimensions may be varied according to installation requirements.

Thus, it can be seen that the present invention provides a novel insulated siding panel assembly having a synthetic resin backing member which is inexpensive and easy to manufacture and which provides improved support for the outer panel. The siding panel assembly may be easily interengaged to an adjacent panel and secured to a vertical support surface in a clapboard configuration. In one embodiment a double clapboard configuration is provided by offset body sections in the outer panel and backing member.

Having thus described the invention, I claim:

1. An insulated siding panel assembly comprising an elongated outer panel formed of deformable sheet material and having a body section providing parallel inside and outside faces and a flange extending along at least one longitudinal edge thereof; and an elongated synthetic resin backing member of greater thickness than said sheet material of said outer panel and having generally planar parallel major surfaces with one of said major surfaces being disposed against said inside face thereof, the other of said major surfaces having at least one rib thereon spaced intermediate the longitudinal edges thereof and projecting away from said inside face of said outer panel to provide a surface for abutment against the surface of a wall upon which said panel assembly is mounted, and wherein said backing member provides resistance to deformation of said outer panel.

2. The insulated siding panel assembly of claim 1 wherein said outer panel and said backing member each have a transverse configuration providing two body sections with generally planar major surfaces extending in generally parallel planes joined by a web extending at an angle to said planes of said body sections in the same direction as said flange to space the planes of said body sections, each of said backing member body sections having intermediate its longitudinal edges a longitudinally extending rib projecting away from said inside face of said outer panel body section, whereby said siding panel assembly has a double clapboard configuration with each section of said siding panel supported for resistance to deformation.

3. The insulated siding panel assembly of claim 1 wherein said flange extends inwardly of said inside face of said outer panel and has a lip extending in spaced relationship to said inside face to provide a U-shaped channel along said longitudinal edge thereof.

4. The insulated siding panel assembly of claim 1 wherein said outer panel has a second flange extending adjacent the other longitudinal edge thereof and outwardly of said outside face thereof.

5. The insulated siding panel assembly of claim 1 wherein said synthetic resin backing member has a closed cellular structure.

6. The insulated siding panel assembly of claim 1 wherein said backing member is of substantially uniform thickness with said rib being defined by a corrugation providing a recess in said one surface thereof.

7. An insulated siding assembly having a clapboard configuration comprising a plurality of interengaged siding panel assemblies each comprising an elongated outer panel formed of deformable sheet material and having a body section providing parallel inside and outside faces and flanges extending along both longitudinal edges thereof, and an elongated synthetic resin backing member of greater thickness than said sheet material of said outer panel and having generally planar parallel major surfaces with one of said surfaces being disposed against said inside face thereof, the other surface of said backing member having at least one rib thereon spaced intermediate the longitudinal edges thereof and projecting away from said inside face of said outer panel to provide a surface for abutment against the surface of a wall upon which the panel assemblies are mounted, the longitudinal flanges of adjacent panels being interengaged, and said backing members providing resistance to deformation of the cooperating outer panels.

8. The insulated siding assembly of claim 7 wherein each of said outer panels and each of said backing members have a transverse configuration providing two body sections with generally planar major surfaces extending in generally parallel planes joined by a web extending at an angle to said planes of said body sections to space the planes of said body sections, each of said backing member body sections having intermediate its longitudinal edges a longitudinal extending rib projecting away from said inside face of said outer panel body section, whereby each of said siding panel assemblies has a double clapboard configuration with each section of said siding panel supported for resistance to deformation.

9. The insulated siding assembly of claim 7 wherein one longitudinal flange projects inwardly of said inside face and has an upturned lip extending in spaced relationship to said inside face to provide a generally U-shaped channel, and wherein the other flange projects outwardly of said outer face thereof, said U-shaped channel on one of said outer panels seating said outer flange of the adjacent outer panel to secure said siding panel assemblies in a clapboard configuration.

10. The insulated siding assembly of claim 9 further including a plurality of spaced stringers extending transversely of said siding panel assemblies, each of said stringers having mounted means longitudinally spaced thereon cooperating with said U-shaped channels and said other flanges of said outer panels to secure said siding panel assemblies to said stringers.

11. The insulated siding assembly of claim 7 wherein the distance from the plane of said one face of the backing member adjacent the outer panel to the opposite face of the rib at its maximum spacing exceeds the width of said flanges and said ribs abut a vertical support surface when said siding panel assemblies are mounted thereon to provide resistance to deformation of said outer panels.

* * * * *

UNITED STATES PATENT AND TRADEMARK OFFICE

CERTIFICATE OF CORRECTION

PATENT NO. : 3,998,021

DATED : December 21, 1976

INVENTOR(S) : EUGENE R. LEWIS

It is certified that error appears in the above-identified patent and that said Letters Patent are hereby corrected as shown below:

Column 6, line 41, "mounted" should be --mounting--.

Signed and Sealed this

Tenth Day of May 1977

[SEAL]

*Attest:*

RUTH C. MASON
*Attesting Officer*

C. MARSHALL DANN
*Commissioner of Patents and Trademarks*